US008474890B2

(12) United States Patent
Buhagiar

(10) Patent No.: US 8,474,890 B2
(45) Date of Patent: Jul. 2, 2013

(54) ANIMAL WASTE DISPOSAL TOOL

(76) Inventor: Jordan A Buhagiar, West Sacramento, CA (US)

( * ) Notice: Subject to any disclaimer, the term of this patent is extended or adjusted under 35 U.S.C. 154(b) by 120 days.

(21) Appl. No.: 13/068,854

(22) Filed: May 11, 2010

(65) Prior Publication Data

US 2012/0038178 A1 Feb. 16, 2012

Related U.S. Application Data

(63) Continuation-in-part of application No. 12/136,309, filed on Jun. 10, 2008.

(51) Int. Cl.
*A01K 29/00* (2006.01)

(52) U.S. Cl.
USPC ..... 294/1.4; 294/50.5

(58) Field of Classification Search
USPC ..... 294/1.2, 1.3, 1.4, 1.5, 209, 50.5, 294/50.9, 61; 15/257.1, 257.2, 257.3, 257.01, 15/104.001; 119/161, 867
See application file for complete search history.

(56) References Cited

U.S. PATENT DOCUMENTS

| | | | | |
|---|---|---|---|---|
| 658,831 | A | 10/1900 | Danielsen | |
| 2,800,354 | A | 7/1957 | King | |
| 2,804,336 | A | 8/1957 | Thompson | |
| 3,879,079 | A * | 4/1975 | Nicholas | 294/1.4 |
| 4,019,768 | A | 4/1977 | Niece | |
| 4,032,182 | A | 6/1977 | D'Ath | |
| 4,102,547 | A | 7/1978 | Williams | |
| 4,148,513 | A | 4/1979 | Gagne | |
| 4,200,321 | A | 4/1980 | Warkentin | |
| 4,316,627 | A | 2/1982 | Solypa | |
| 4,368,907 | A | 1/1983 | Ross | |
| D285,012 | S * | 8/1986 | Willis | D30/162 |
| 4,641,873 | A * | 2/1987 | Nurnberger | 294/1.4 |
| 4,846,286 | A | 7/1989 | McNeely et al. | |
| 5,370,433 | A | 12/1994 | Yost | |
| 5,562,318 | A | 10/1996 | McBroom | |
| 5,564,267 | A | 10/1996 | Bricker et al. | |
| 5,667,264 | A | 9/1997 | Tanahara | |
| 5,788,299 | A | 8/1998 | Wilkinson | |
| 6,019,405 | A * | 2/2000 | Tsou | 294/1.4 |
| 6,030,011 | A * | 2/2000 | Layton | 294/1.4 |
| 6,349,776 | B1 | 2/2002 | Hus | |
| 6,478,351 | B1 * | 11/2002 | Nelson | 294/1.4 |
| 6,554,334 | B2 | 4/2003 | Rincon Uribe | |
| 6,634,163 | B2 | 10/2003 | Kill | |
| 6,796,587 | B2 * | 9/2004 | Tsou | 294/1.4 |
| 2005/0082854 | A1 | 4/2005 | Barr | |

FOREIGN PATENT DOCUMENTS

| | | | |
|---|---|---|---|
| WO | WO 93/06307 | A1 | 4/1993 |
| WO | WO/2008/024069 | A1 | 2/2008 |

* cited by examiner

*Primary Examiner* — Stephen Vu
(74) *Attorney, Agent, or Firm* — Edward S. Sherman

(57) ABSTRACT

A tool for retrieving animal waste is effective in complete removal as it deploys at its end a row of tines that are inserted beneath the solid waste so that is can be lifted from the ground as the first step for proper disposal. The waste is then removed from the tines by a plate that pushes it off into a waste receptacle.

22 Claims, 12 Drawing Sheets

FIG. 1A
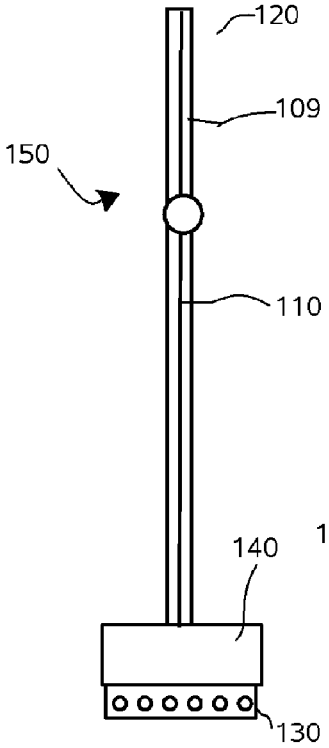
FIG. 1B
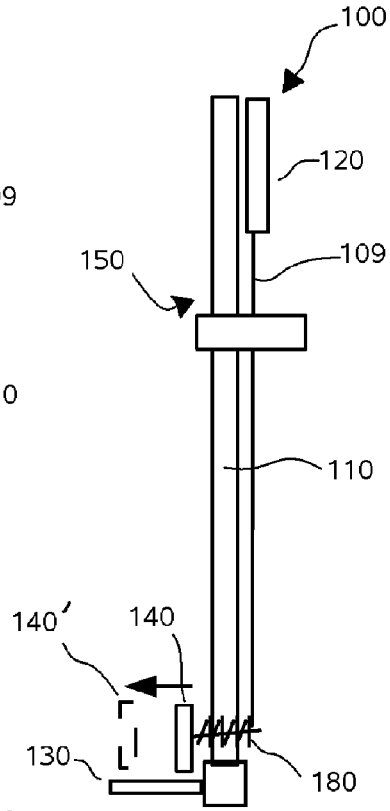
FIG. 1C
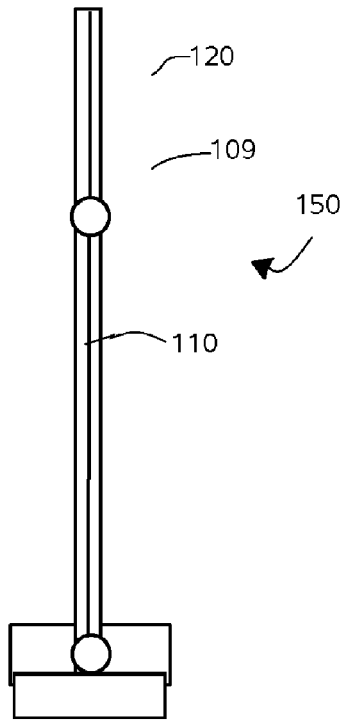
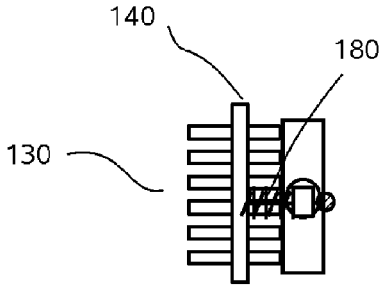
FIG. 1D

FIG. 2A
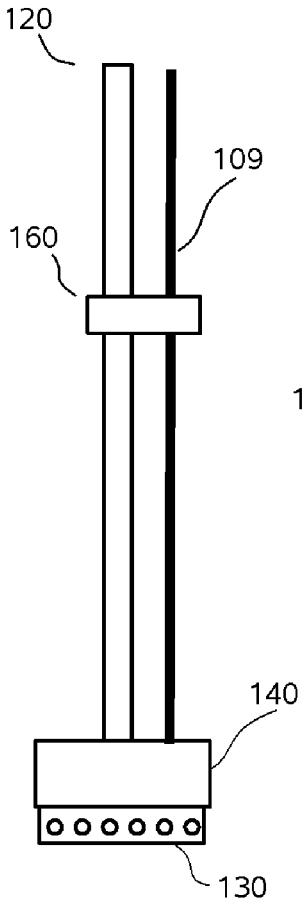
FIG. 2B
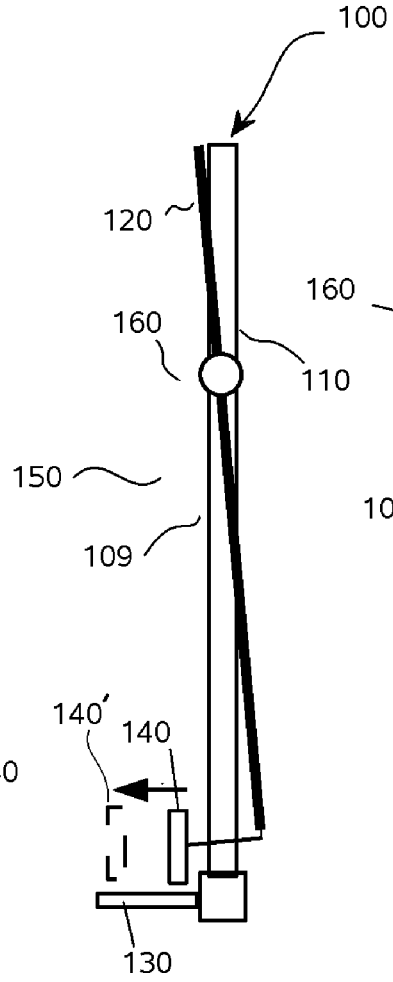
FIG. 2C
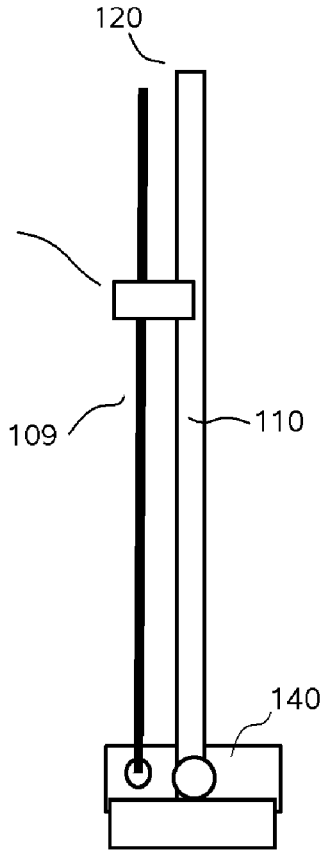
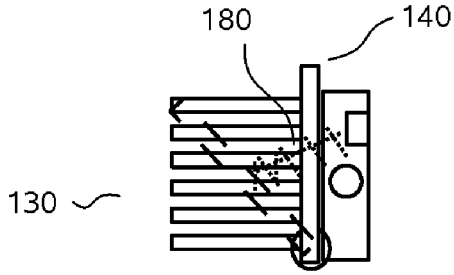
FIG. 2D

FIG. 3A
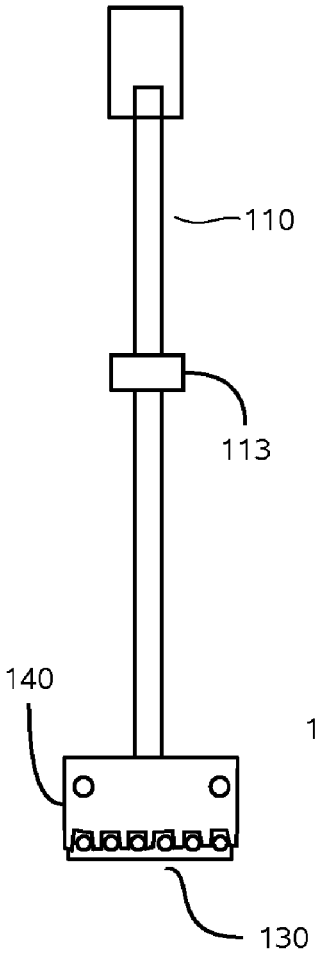
FIG. 3B
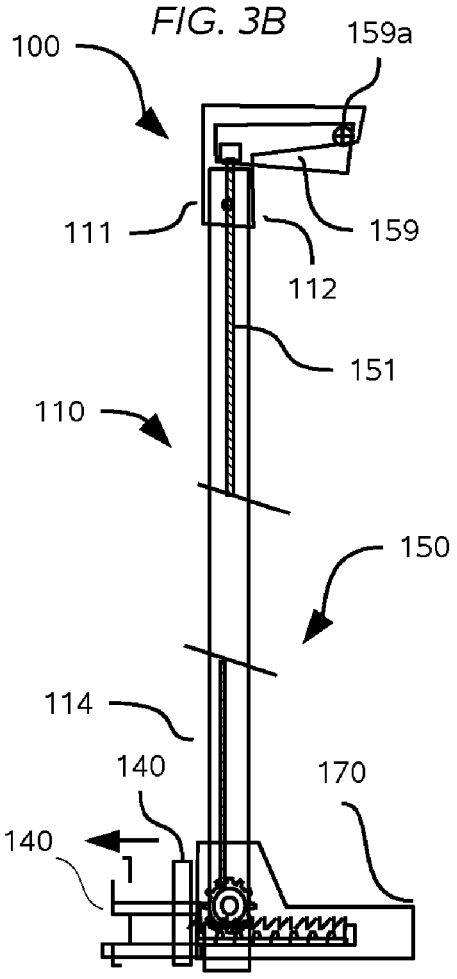
FIG. 3C
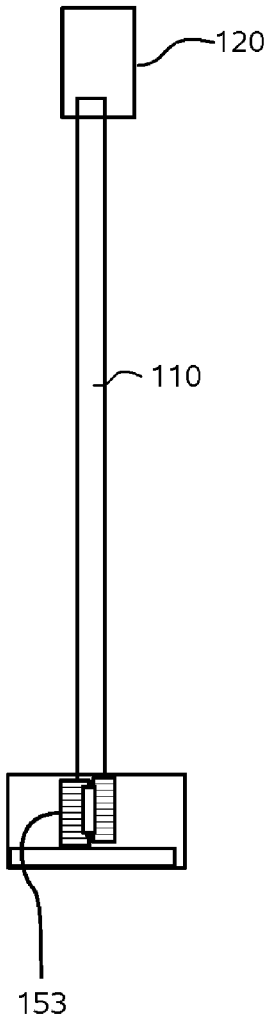
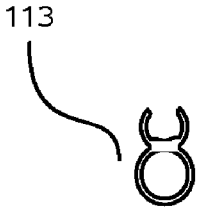
FIG. 3E
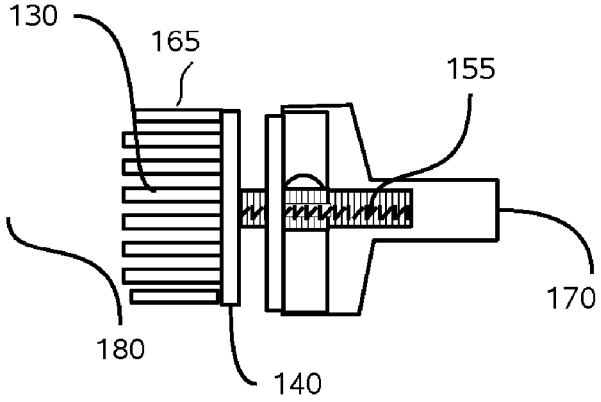
FIG. 3D FIG. 6A
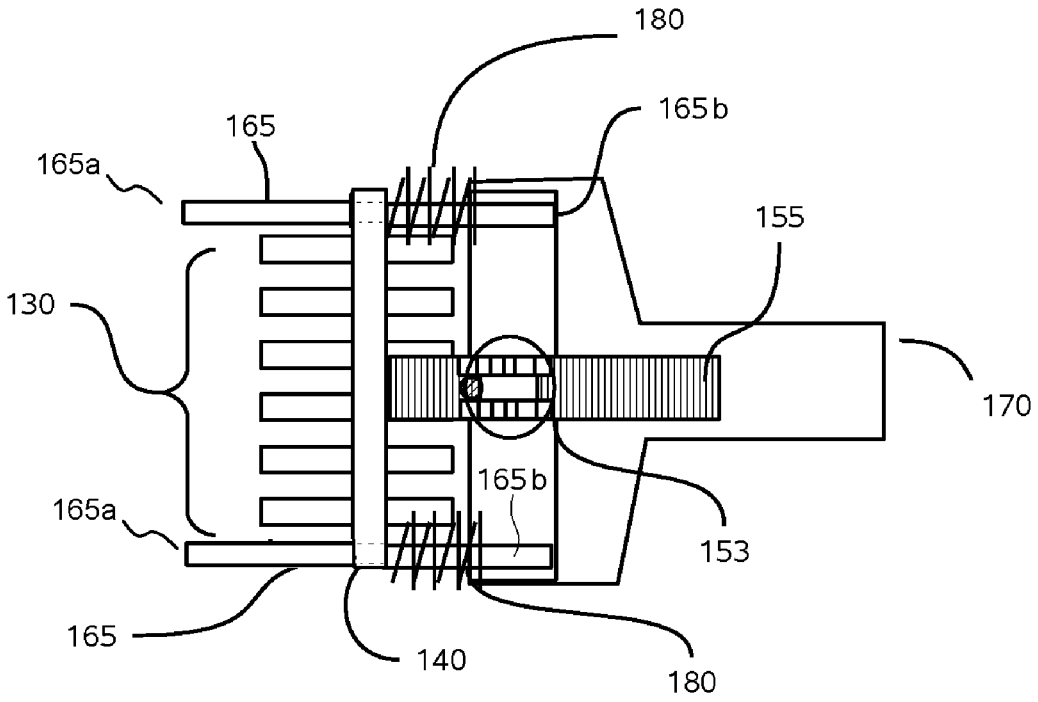
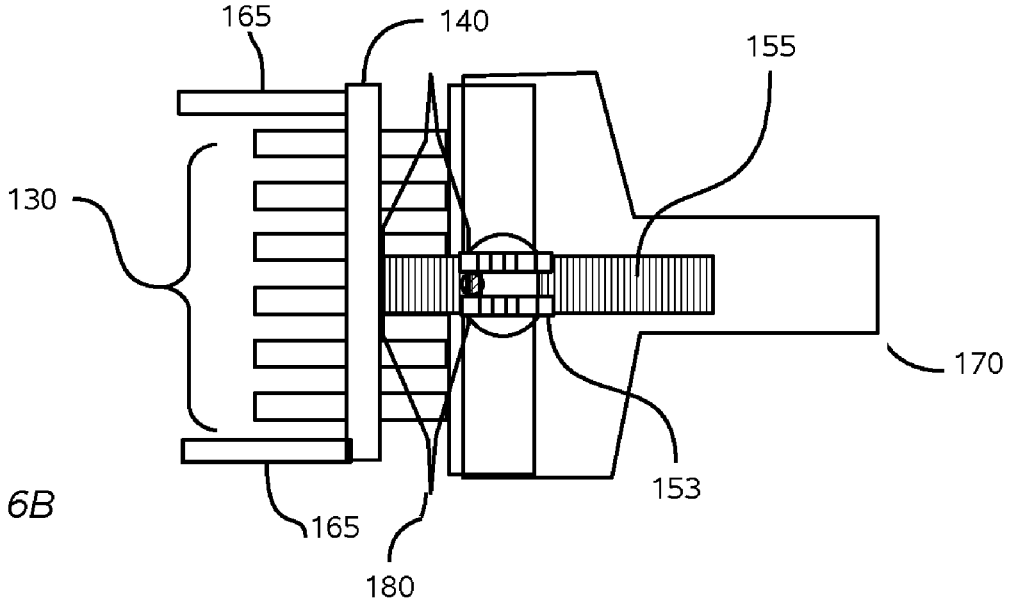
FIG. 6B FIG. 7A
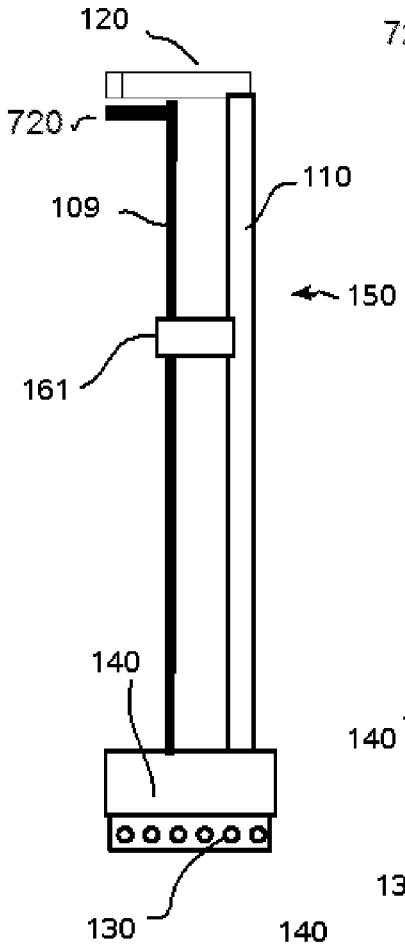
FIG. 7B
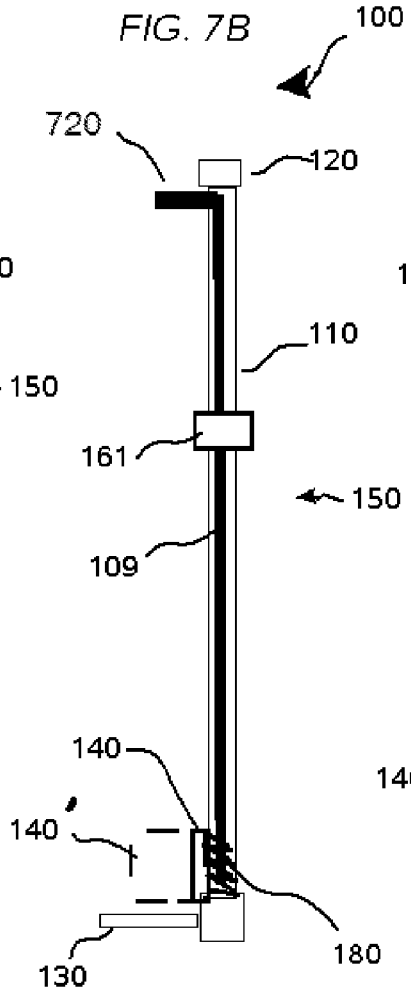
FIG. 7C
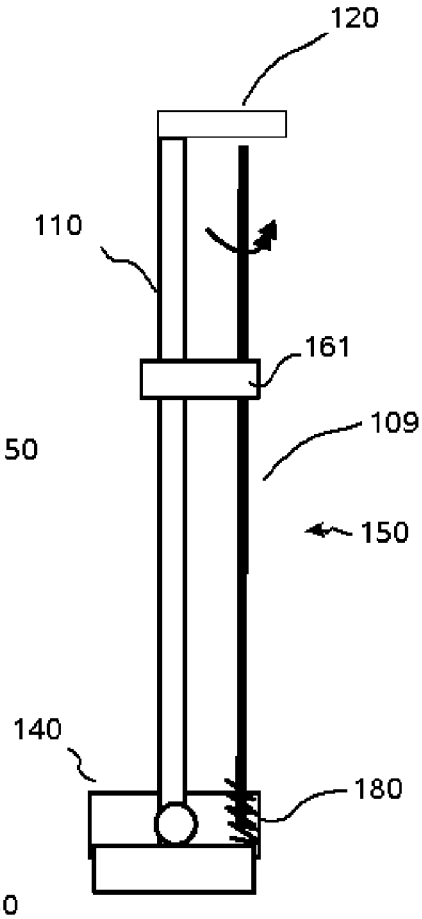
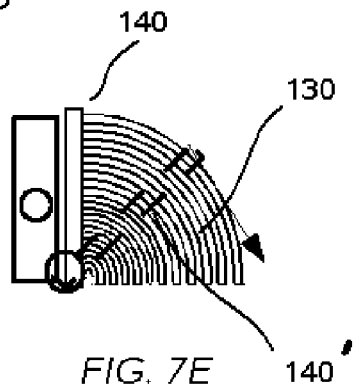
FIG. 7E
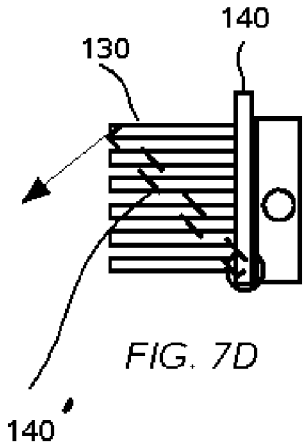
FIG. 7D

ANIMAL WASTE DISPOSAL TOOL

CROSS REFERENCE TO RELATED APPLICATIONS

The present application is a conversion of the U.S. Provisional patent application filed on May 11, 2010, and is also a Continuation-in-Part of and claims the benefit of priority to the US Non-provisional patent application of the same title filed on Jun. 10, 2008, having application Ser. No. 12/136,309, which is incorporated herein by reference.

BACKGROUND OF INVENTION

The present invention relates to a device for animal waste disposal

It is desirable and frequently required by law that pet owners promptly remove pet dropping from public parks and sidewalks, as well as from private property, for health reasons, as well as the damage it does to grass and other vegetation.

As many pet owners do not wish to bend over and use papers or plastic bags to remove droppings by hand an array of devices have been developed.

However, many of these prior art device are deficient are deficient in one manner or another as will be discussed below. Virtually all prior art devices attempt to provide a more sanitary means of removing pet waste, that is to avoid contact. Some these prior art devices use one of more scoops o shovel shapes to capture the waste. Frequently, these prior art devices tend to either incompletely remove droppings, or if used to completely remove the dropping also require the removal of surrounding grass and soil, and are hence also injurious to landscaping.

Further, these devices also tend to collect animal waste residue, and hence require regular cleaning and additional maintenance.

If the tools are used move aggressively to remove all residues, more residues tend to stick to the tool. Further, the tool portion that contacts the waste can be difficult to clean.

Accordingly it is a first object of the invention to provide an improved means to remove animal droppings, and particular pet droppings wherein the user/handler need not stoop over.

It is yet another object of the invention to provide such an improved apparatus that can completely remove such animal waste, yet will not damage grass or ground cover.

It is still a further object of the invention to provide such a device having the above attributes, that while capable of completely removing such animal droppings of varying consistency , will not become soiled or clogged and will hence be easier to clean and maintain.

it is another objective of the invention to provide a simple and hygienic means to remove the waste from such a device by collecting it in a sealed bag.

SUMMARY OF INVENTION

In the present invention, the first and other objects are achieved by providing a method of removing animal waste, the method comprising the steps of: providing a tool having a lateral lifting surface at one end, a plate disposed over said lifting surface for sweeping waste off the lifting surface when loaded thereon, wherein the lifting surface and plate are disposed at the end of a shaft, inserting the lifting surface under the waste to be removed, lifting the shaft upward to remove the waste from the ground, transporting the waste to a disposal container, translating the plate over the lifting surface to urge the waste there from whereby it falls in the disposal container.

In a second aspect of the invention other objects are achieved by providing a tool for animal waste removal, the tool comprising a shaft having a top and a bottom, a handle at top of shaft, a container at the bottom of the shaft, the container comprising a front opening , a partial top opening, a plurality of 2 or more apertures distributed on 2 or more sides of the container proximal to the perimeter of the front opening, wherein the shaft is connected to the container on a portion of the container between the front opening and the partial top opening.

A third aspect for the invention is achieved by providing a tool kit for animal waste disposal comprising a first tool comprising: as haft having a top and a bottom, a handle at top of shaft, a lateral lifting surface disposed in a first common plane, said first common plan being substantially horizontal to and coupled to the bottom of said shaft, a plate disposed perpendicular and immediately above said plurality of tines, an actuator coupling said handle to said plate wherein the operation of said actuator via said handle urges said plate to move in said first common plane perpendicular to said lateral lifting surface, a second tool comprising: a shaft having a top and a bottom, a handle at top of shaft, a container at the bottom of the shaft, the container comprising, front opening, a partial top opening, a plurality of 2 or more apertures distributed on 2 or more sides of the container proximal to the perimeter of the front opening, wherein the shaft is connected to the container on a portion of the container between the front opening and the partial top opening, and wherein said lateral lifting surface and said plate of said first tool fit substantially with the front opening of said second tool.

The above and other objects, effects, features, and advantages of the present invention will become more apparent from the following description of the embodiments thereof taken in conjunction with the accompanying drawings.

BRIEF DESCRIPTION OF THE DRAWINGS

FIGS. 1A-C are schematic elevations of the front, side and rear respectively of a first embodiment of the invention, while FIG. 1D is a plan view thereof FIGS. 2A-C are schematic elevations of the front, side and rear respectively of a second embodiment of the invention, while FIG. 1D is a plan view thereof.

FIGS. 3A-C are schematic elevations of the front, side and rear respectively of a third embodiment of the invention, while FIG. 1D is a plan view.

FIG. 3E is a plan view of the clip shown in FIG. 3A at section line E-E.

FIG. 6A is a plan view of an alternative embodiment of the moving plate portion.

FIG. 6B is a plan view of another alternative embodiment of the moving plate portion.

FIGS. 7A-C are schematic elevations of the front, side and rear respectively of a fourth embodiment of the invention, while FIG. 7D is a plan view thereof. FIG. 7E is an alternative embodiment of the portion shown in FIG. 7D.

FIGS. 8A and 8B illustrate an alternative embodiment of an actuator, in which FIG. 8A is a perspective view of the lower portion of the device from slightly above the side and FIG. 8B is a cut away perspective view of a portion of the interior mechanism of the actuator from slightly above and behind the lower portion of the device.

DETAILED DESCRIPTION

Figure 4:
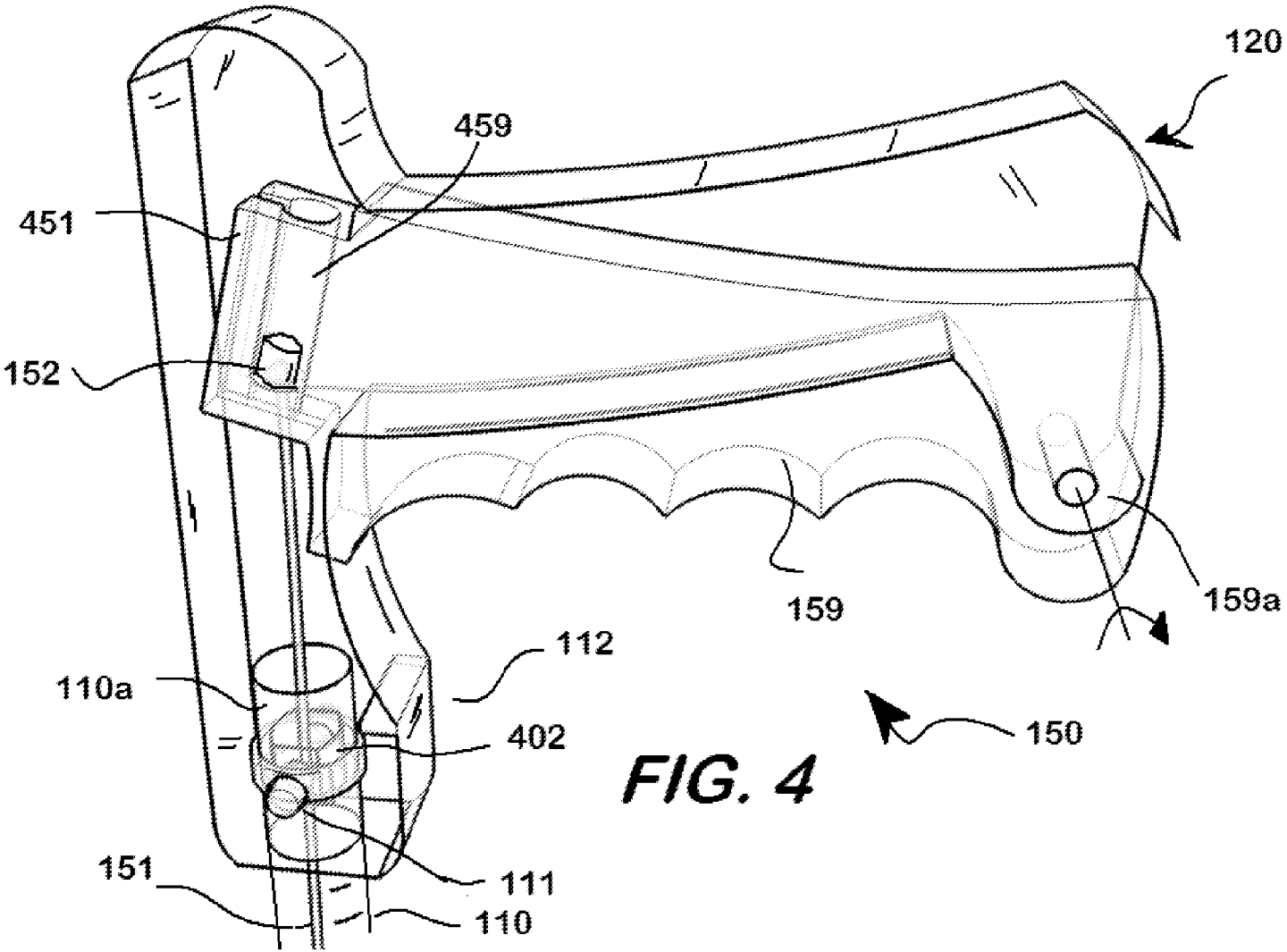
FIG. 4 is a perspective view of the interior of the actuator mechanism at the handle trigger end.

Referring to FIGS. 1 through 11, wherein like reference numerals refer to like components in the various views, there is illustrated therein a new and improved Animal Waste Disposal Tool, generally denominated 100 herein, and an animal waste collection tool 200.

In accordance with a first embodiment of the present invention, FIG. 1 illustrates tool 100 having a shaft 110 having a top 110*a* and a bottom 110*b*, with a handle 120 generally disposed toward the top of shaft 110. At the opposing or bottom end 110*b* of shaft 110 a plurality of tines 130 are disposed in a first common plane 131, said first common plane being substantially horizontal to and coupled to the bottom of said shaft. A plate 140 is disposed perpendicular and immediately above the plurality of tines 130. Tines 130 should be understood to mean a plurality of slender elongated members that are spaced apart from each other a substantially equal distance along their lengths, and though preferably straight, can also be curved. The cross section of such times is optionally circular, but can have other shapes, such as square, triangular, elliptical or rectangular so long as the dimension of the cross section are a fraction of the length that the tines extend away from a common plane or line of origin. Thus, tines, can also be understood to apply to members have a blade like shape. Like a blade, the cross section need not be constant over the length to achieve the function and benefits described in more detail below, as the slender spaced apart nature of such times allows them to slip through blades of grass without disturbance or damage to the live vegetation as descried further below.

An actuator 150 coupling the handle 120 to plate 140 wherein the operation of said actuator 150 via said handle 120 urges said plate 140 to move in the common plane perpendicular to the plurality of tines 130. Plate 140 is shown in alternative position in broken lines and labeled 140' in the Figures.

It should be understood that it is more preferable that each of the embodiments also comprises a spring biasing mechanism 180, such as leaf spring(s), coils springs and torsion springs and the like, as shown in FIGS. 6A and 6B, as well as FIG. 7. In particular, it is preferable to deploy a torsion spring when plate 140 rotates about or adjacent to shaft 110 in FIG. 5. The spring 180 preferably supplies a constant and controlled minimum force to eject waste off the tines 130.

As shown in FIG. 1, the actuator mechanism 150 alternatives include a rotating bar connecting the plate to the handle, as well as a bar that slides in and out, each extending from the plate to the top of the shaft. The top of this bar is the handle. The bar can be connecting to the shaft at some intermediate position by a slide or pivot mechanism. The slide or pivot can include a biasing means. Actuator may include a cable actuator and/or a coupling to magnify the plate displacement with respect to the handle displacement. Alternative actuator mechanisms can be any found in the prior art search.

The tines 130, being spaced apart with gaps is readily inserted under the waste matter without while slide through blades or grass and other vegetative matter. Accordingly, when the operator lifts the tool 100 upward, they pick up the waste but also do not damage the grass as it ready slips through the tines. Dispose.

Accordingly, it will now be appreciated that the device 100 improves sanitation and hygiene by complete removal without residue on the ground as animal waste can be removed without direct contact. Further, the user of the device need not stoop over to remove waste, nor carry, buy or find plastic bags is general purpose waste receptacle are in the general vicinity. The tine arrangement minimizes the potential for leaving waste residue on the tool, as the contact therewith is minimizes and not pressure is asserted to squeeze the waste onto the tool other than its own mass. Likewise, as the plate 140 slides across the tines 130, and will readily remove the waste there from without leaving significant residue. Further, the tool 100 portions, which is the tines 130 and the plate 140 that contacts residue, are easy to clean.

In FIG. 1 the actuator 150 deploys another or secondary shaft 109 coupled at the bottom to the plate 140 and at the top to the handle 120. The secondary shaft 109 and slides laterally with respect to the main supporting shaft 110, remaining parallel thereto. Various combinations of spring 180 elements shown in other embodiments can be used to bias the plate 140 to either alternative position. Further, the secondary shaft 109 is optionally supported at the center as shown, but more preferably at both the top and bottom by slots or channel that extend from the main shaft 110, so that it is restrained to move laterally.

In FIG. 2 the actuator 150 is another or secondary shaft 109 coupled at the bottom to the plate 140 and at the top to the handle 120. The secondary shaft 109 pivots about the center of the main supporting shaft 110, via a rotary coupling 160, thus the movement of handle 120 forward, retracts plate 140, while the backward movement propels it forward along with plate 140 to push waste matter off the tines 130. Various combinations of spring 180 elements shown in other embodiments can be used to bias the plate 140 to either alternative position. The spring 180 elements can be at either the plate 140 end, the handle end 140 or a torsion spring in the rotary coupling 160.

FIG. 3 illustrates a more preferred embodiment that further comprises rails 165 that extend above and parallel to the plurality of tines 130. In various other embodiments the rails 165 also help stabilize the plate 140, acting as plate guides. However, the primary function is to insure that waste cannot fall or slip sideways off the tines 140 was it is lifted off the ground. Preferably, the plate 140 has a lower portion with fingers that are inter-digitated to extend into the gaps between the tines 130.

In the embodiment of FIG. 3, the actuator mechanism 150 comprises a cable 151 that is responsive to squeezing the trigger 159 portion of handle 120. The cable 151 terminates at the upper portion with a capping cylinder 152, shown in more detail in FIG. 4 in a transparent perspective view. The capping cylinder 152 and the top portion of the cable 151 are inserted into the opposite end of the trigger 159 which has with a downward oriented hole 459 and a side slit 401 that extends laterally to reach the entire length of the hole. The hole has an upper portion that is wide enough to retain the capping cylinder 152. This upper portion is followed by a lower portion that is just wider than the cable, but narrower than the capping cylinder; so that when the cable is inserted in the slot and pulled downward (or the block pulled upward) the capping cylinder 152 will be retained in this hole in the trigger 159.

In the embodiment of FIG. 3, the actuator mechanism 150 comprises a cable 151 that is responsive to squeezing the trigger 159 portion of handle 120. The cable 151 terminates at the upper portion with a capping cylinder 152, shown in more detail in FIG. 4 in a transparent perspective view. The capping cylinder 152 and the top portion of the cable 151 are inserted into the opposite end of the trigger 159 (distal from rotary coupling 159*a*)which has with a downward oriented bore hole 459 and a side slit 451 that extends laterally to reach the entire length of the bore hole 459. The bore hole 459 has an upper portion that is wide enough to retain the capping cylinder 152. This upper portion is followed by a lower portion that is just wider than the cable, but narrower than the capping cylinder; so that when the cable is inserted in the slot and pulled downward (or the block pulled upward) the capping cylinder 152 will be retained in this bore hole 459 in the trigger 159.

Figure 5:
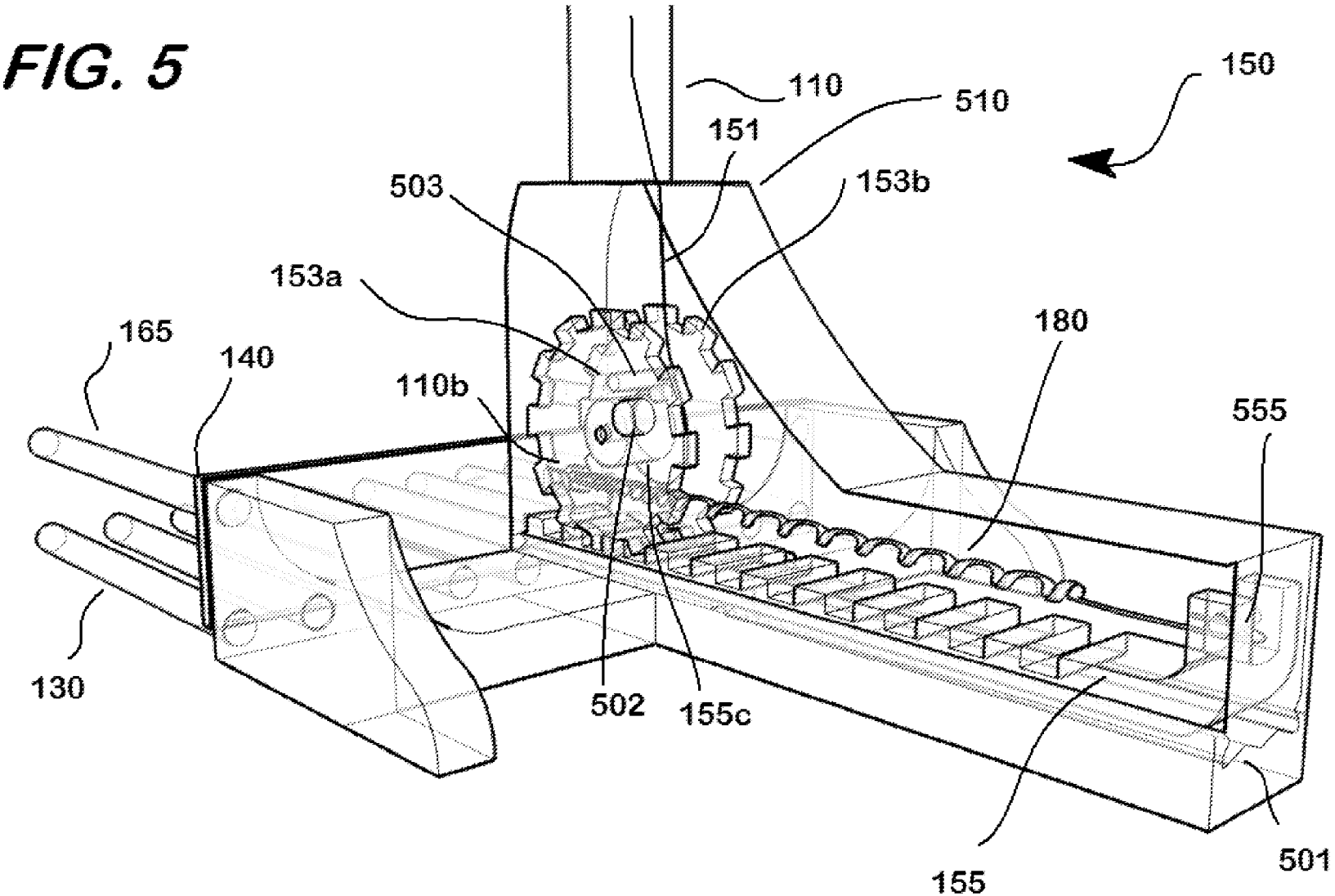
FIG. 5 is a perspective view of the interior of the actuator mechanism at the bottom of the shaft with the tines and moving plate.

As shown in detail in FIG. 5, the opposite end of the cable 151 at the base of shaft 110, that is side 110*b*, is connected in rotary engagement with a round gear 153 that is divided into two axially separated portions which are round gears 153*a* and 153*b*. The intervening axle 155*c* is thus driven by the cable 151 via the grip handle trigger 159. The trigger 159 mechanism has a rotary coupling 159*a* at the end of the hand grip so that when it is squeezed and pulled backward into the handle the cable 151 is pulled upward. Then, at the opposite end of the actuator 150, the cable 151 rotates the round gear 153 and urges the plate 140 backward, thus compressing the spring 180.

The cable 151 is physically attached to the intervening axial 155*c*. Further, at least one of the round step gears 153*a* and 153*b* has an off center external projection 502 on its outside that is intended to engage a similar projection 503 extending inward from the case 510, and thus limit the range of rotary motion of the round gear 153 to the intended travel range of the cable 151.

Each of the axially separated round step gears 153*a* and 153*b* simultaneously engage tracks of flat gear 155. By flat gear we mean the arrangement of gear teeth in a linear coplanar arrangement. The portion of the flat gear 155 most distal from plate 140 has a vertical portion 555 for supporting a spring 180. The end of spring 180 distal from plate 140 is connected toward the top of this vertical portion. The flat gear 155 fits and slides in the rectangular well in the base having a series of tracks 501 in the bottom that are in a triangular shape, making limited contact with the reverse side of the flat gear, opposite the teeth thereof, to minimize friction. However, these are merely the currently preferred embodiment s of the flat gear and well, which need not have the shapes or contact areas shown, as other shapes such as circular, oval and trapezoidal are possible. The spring 180 that biases the plate 140 with respect to the bottom 110*b* of the shaft 110 extends above and in the same direction as the track gear, being below the intervening axle 155*c*, and thus in the gap between the round gears 153*a* and 153*b*.

The proximal end of the flat gear 155 is connected to the reverse side of plate 140, which is the side facing shaft 110. The proximal end of the spring 180 is connected or coupled to the base near the bottom 110*b* of shaft 110. The base thus has an aperture so that the flat gear can translated forward and backward as the actuator 150 is engaged.

Further, the handle 120 rotates for left and right handled operation, preferably includes a locking pin 111 in the shaft 110, as the handle has an axial extension 112 that surrounds the upper portion 110*a* of shaft 110, a common lateral locking pin 111 extends through a pair of common lateral holes to prevent the handle 120 from sliding on shaft 110. The locking pin 111 in spring 402 biased detent mechanism that prevent the handle extension portion 112 from rotating with respect to shaft 110 until it is depressed. Locking pin 111 also enable handle 120 to rotate 180 degrees for left and right handled operation. A clip 113 on shaft 110 for holding the shaft on an associated pan with handle. Preferably, but not exclusively, plate 140 moves in the direction of the tines 140 principle axis 145.

As shown in FIG. 5, spring 180 is normally biased to urge the plate 140 toward the end of the tines 130. Then, when the trigger 159 is squeezed and pulled back into the handle, the upward movement of the cable 151 will rotate the round gear 153 thus, causing the plate 140 to move inward from the end of the tines 130 back toward the case 510. It should be appreciated that another alternative embodiment is attaching a spring to the farthest right side of housing of the case 510 to the vertical extension 555 which will bias the plate 140 and flat gear 155 back into the case 510. Then, when the trigger 159 is squeezed and pulled back into the handle, the upward movement of the cable 151 will rotate the round gear 153 thus, causing the plate 140 to move outward to the end of the tines 130.

Alternatively, as shown in embodiment of FIGS. 7D and 7E, the tines 130 are optionally linear or curved respectively, curves tines being preferable when the plate 140 rotates rather than translates in a complete lateral fashion.

In FIG. 6A, guide rails 165 are shown as also having rearward extending appendages 165*b* to plate 140, spaced above tines 130 attached to side 110*b* of the shaft 110. More preferably, a spring 180 is coiled around each guide rail appendage 165*b*, which are behind plate 140 to avoid fouling. Further, the ends 165*a* of guide rails 165*b* extend through mating holes in the base about shaft side 110*b*, and thus stabilize plate 140. FIG. 6B illustrates one alternative embodiment for using a leaf spring 180, as opposed to ordinary coil springs 180 and 180' in FIG. 6A. While leaf spring 180 is oriented with the wide side vertical, it is also possible to deploy leaf springs of other shapes and orientation. Note that the guide rails 165 are attached to the front of plate 140, moving forward therewith. This alternative embodiment can be used with any of the actuator embodiments described herein.

FIGS. 7A-C are schematic elevations of the front, side and rear of a fourth embodiment of the invention, and secondary shaft 109 attached to edge of the plate 140 via a vertical rotary coupling 161. Thus the upper portion of the secondary shaft 109 preferably includes a horizontally extending handle 720 that together with the handle 120 essentially form a trigger mechanism for actuator 150. The plate 140 translates in the plane of the tines by rotating across the tines 130.

In FIG. 7D, which is an alternative embodiment of the portion shown in FIG. 7C, the tines 130 are curved following the curving track of plate 140. It should be apparent that this configuration of curved tines 130 may also be preferable to use with the actuator embodiment shown in FIG. 2. Further, in any of the embodiment the tines 130 and guide rails 165 may have cross sectional shape is optionally round, square, inverted triangles (point up), or flattened or oval. Further, plurality of tines 140 can be replaced with a large flat rectangle lifting plate having the same dimensions, although this would be less desirable for removing animal excrement from grass surface. The plate 140 can move from the handle side of the tine array 130 to the tip thereof in response to the actuator 150, or in the opposite direction so that the rest position of the plate is either at the edge of the tines or at the connection between the tines and the shaft.

Figure 8A:
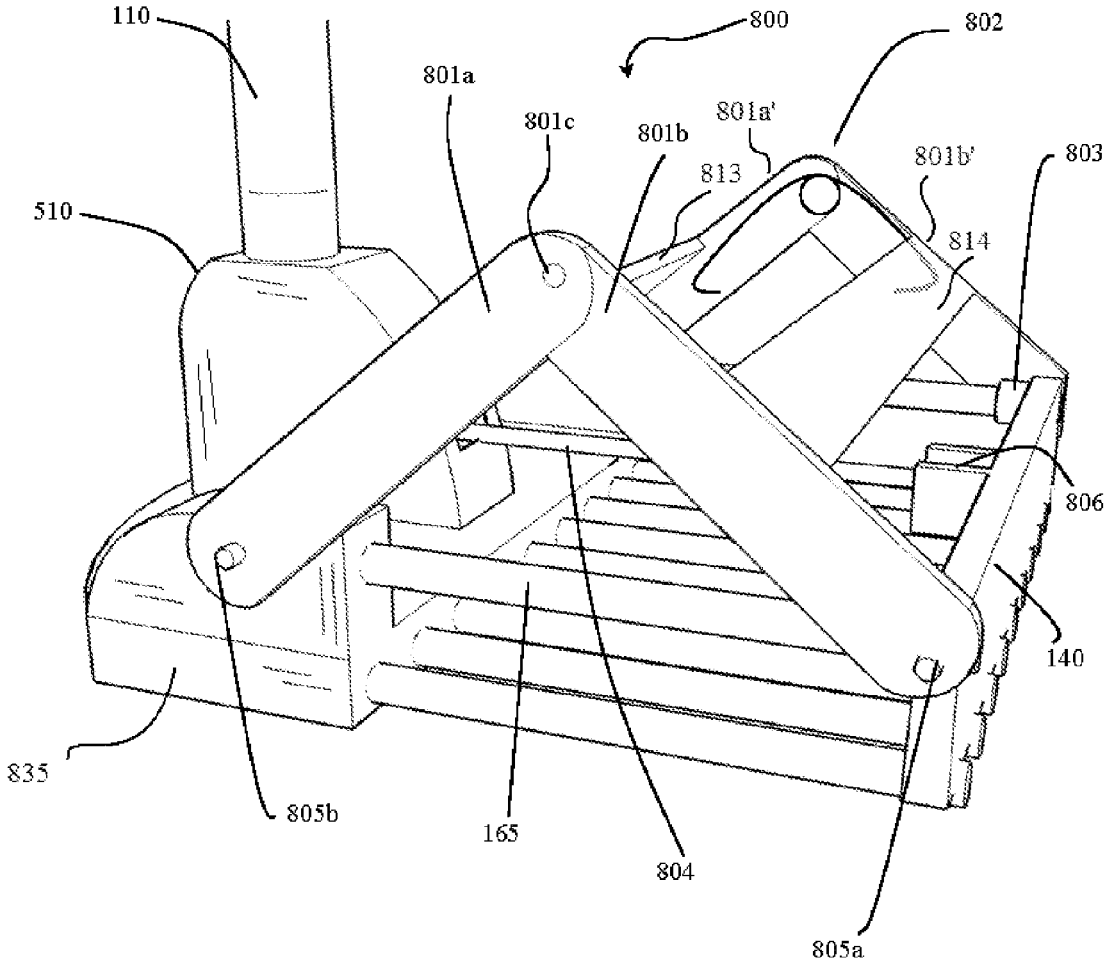
Figure 8B:
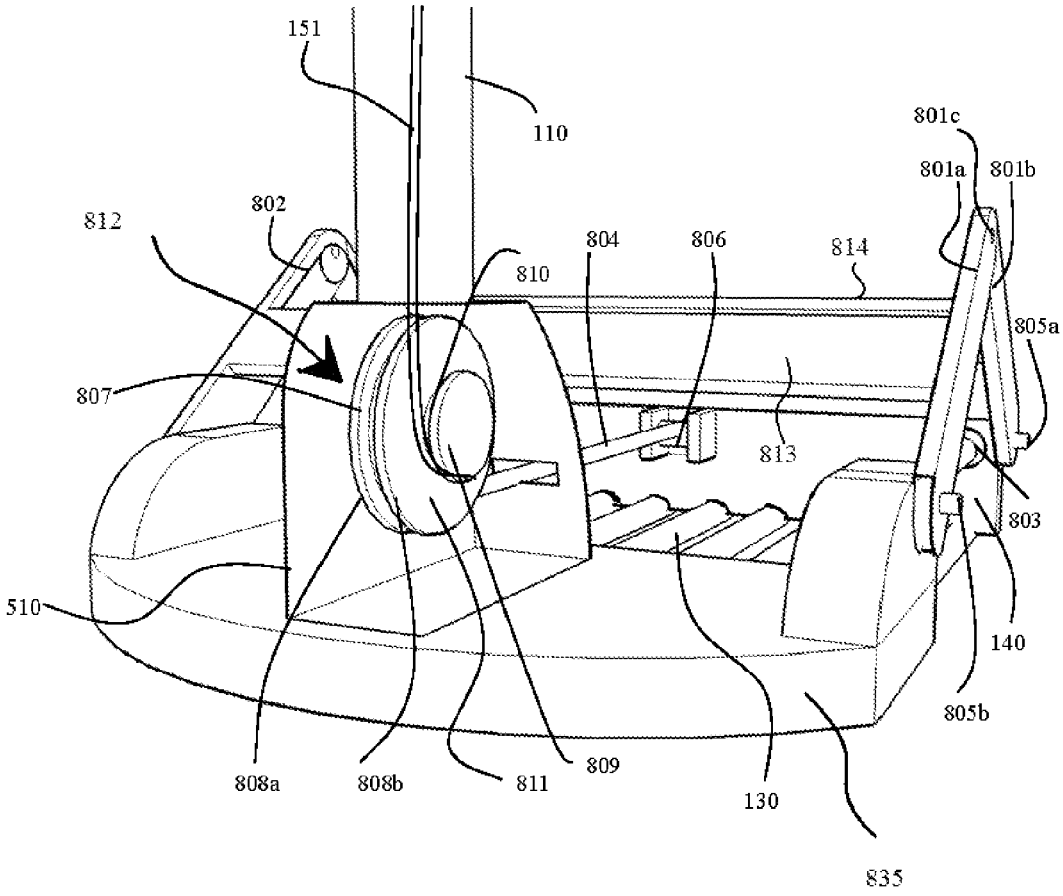
Figure 9C:
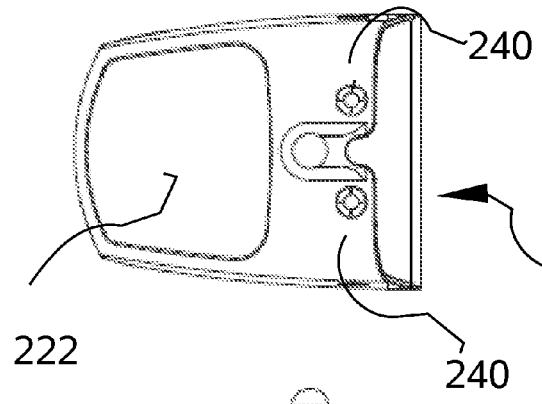
FIG. 9C is a plan view of the of the embodiment of FIGS. 8A and 8B.
Figure 9B:
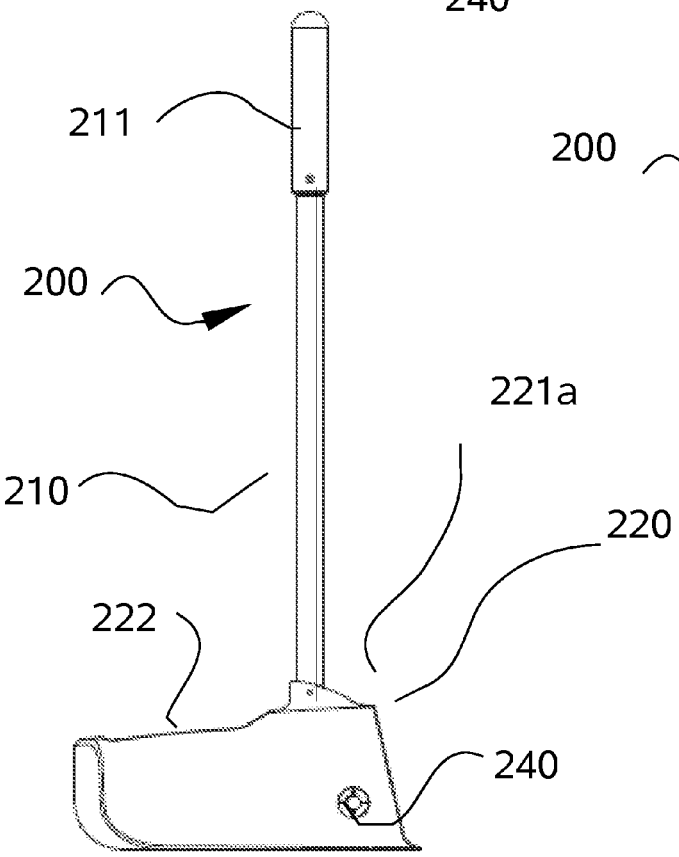
FIG. 9B is a side elevation of the embodiment of FIG. 8A.
Figure 9A:
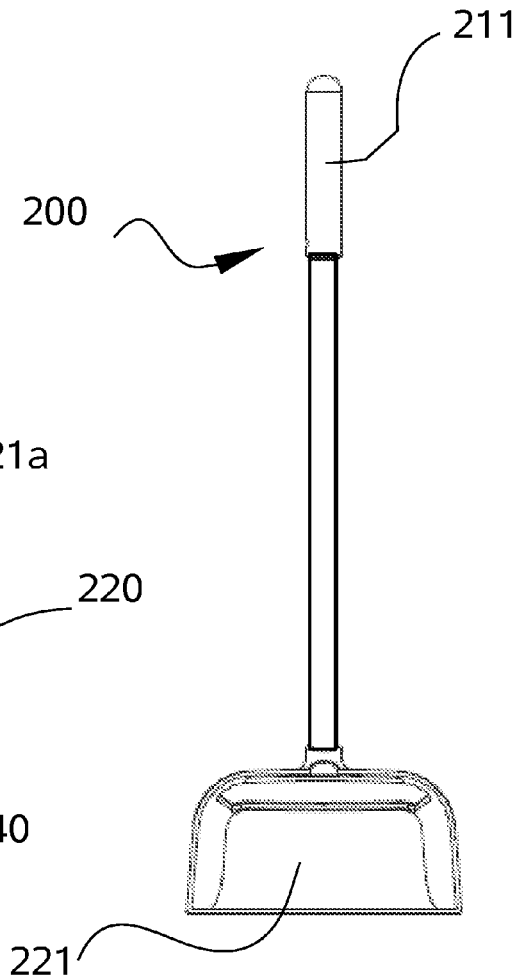
FIG. 9A is a front elevation of a fifth embodiment of the invention for a container for receiving animal waste form the tool of the other embodiments.
Figure 10:
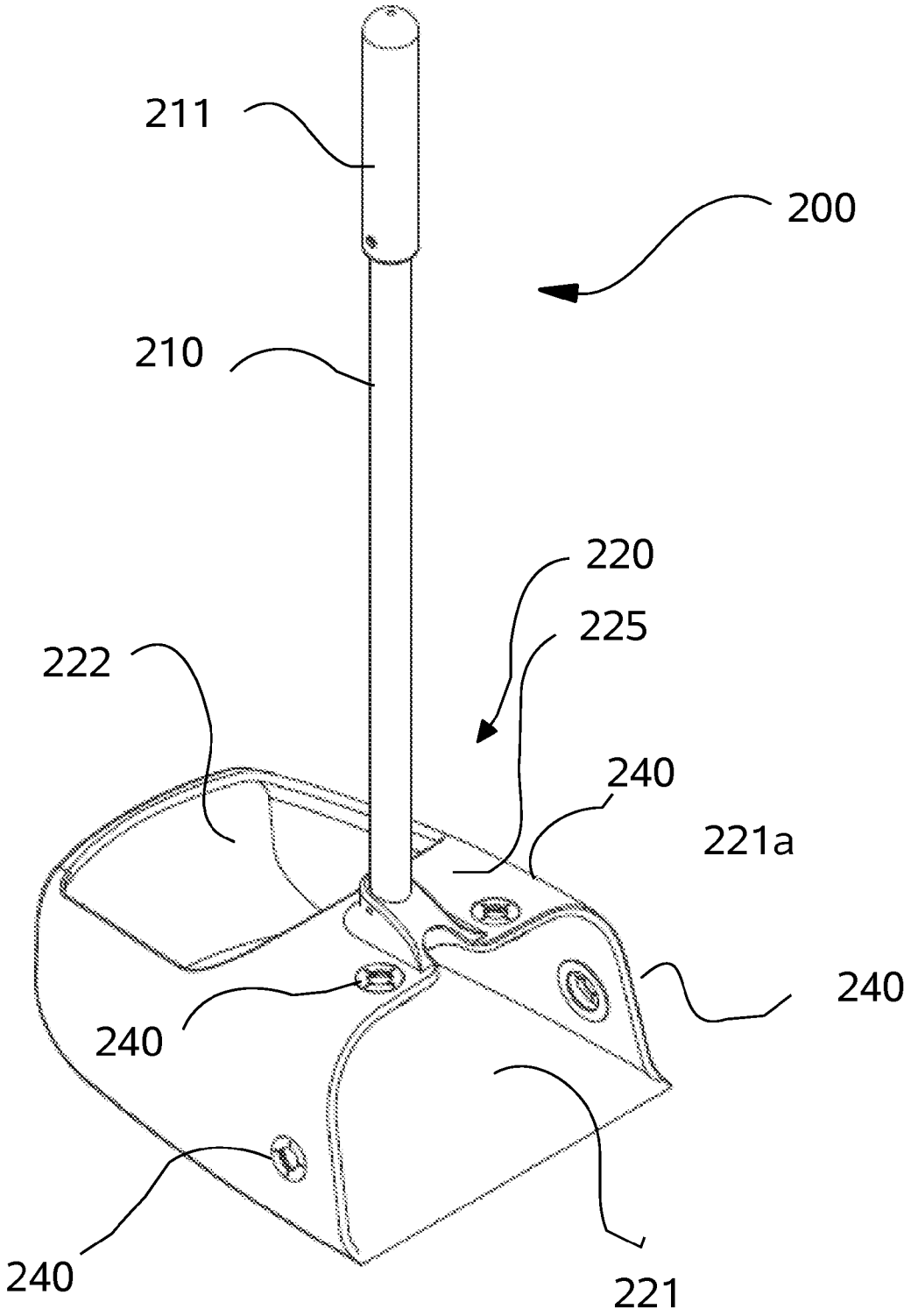
FIG. 10 is a perspective front view of the container of FIG. 9
Figures 11A, 11B:
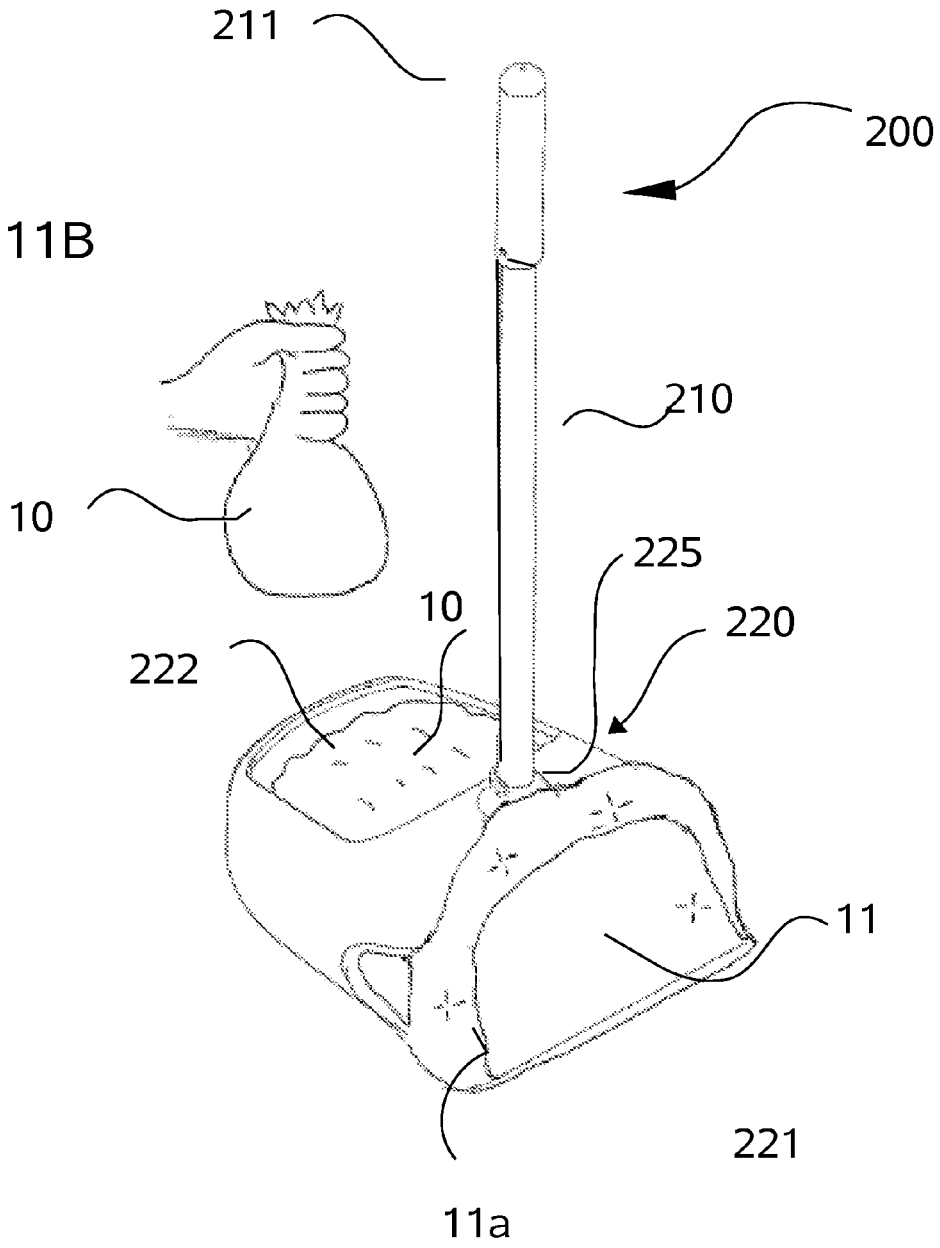
FIG. 11A is a perspective front view of the container of FIGS. 8 and 9 with a plastic waste collecting bag inserted therein.
FIG. 11B shows the plastic waste collection bag after removal.

FIGS. 8A and 8B illustrate an alternative embodiment for a lower portion of the actuator wherein the portion thereof coupled to the flat plate 140 deploys pairs of hinged arms 801*a* and 801*b* that unfold to translate the plate 140 across the tines 130. The pairs of hinged arms 801*a* and 801*b* on one side of tine array 130 are connected by cross members 813 and 814 to the pairs of hinged arms 801'*a* and 801'*b* on the opposite side of the tine array. Arms 801*a* and 801*b* are connected in rotary engagement by a pin 801*a*, as are hinged arms 801*a*' and 801*b*'

In FIG. 8A, the opposite end of each hinge arm 801*b* is connected the near side of plate 140 in rotary engagement via another pin 805*a*, with arm 801*a*' likewise connected to the opposite side of plate 140 via another rotary pin connection.

The opposite side of hinge arm 801*b* and 801*b*' are connected to the near and far sides of the wide base 835 in rotary engagement via pins 805*b*.The base 835 is orthogonal to shaft 110 and has about the same width as plate 140.

The plate 140 has two guide rail sleeves 803 located at opposite ends which enable the plate to slide along the guide rails 165. Pairs of torsion spring 802 are coupled to the interior walls of hinge arms 801*a* and 801*b* to bias the rotation there between at pin 801*c* and 801*c*', normally urging the plate 140 toward the end of the tines 130.

As shown in detail in FIG. 8B, a pulley 812 is connected in rotary engagement at the base of shaft 110. The opposite end of the cable 151 that is attached to the trigger 159 is attached to the axle 810 of pulley 812. Pulley 812 also has an inner grooved wheel 811 that is co-axially coupled to rotate with axle 810. Attached to the outer wall of axle 810 is a cable guide 809 that will prevent the cable 151 from slipping off. A second cable 804 is wrapped around protruding post 806 for attachment to the plate 140. The opposite end of the cable 804 is attached within a groove 807 of the inner grooved wheel 811, which is defined by the co-axial cable guide 808*a* and 808*b* to prevent the cable 804 from slipping off laterally. The intervening axle 810 is thus driven by the cable 151 via the grip handle trigger 159. The trigger 159 mechanism has a rotary coupling 159*a* at the end of the hand grip so that when it is squeezed and pulled backward into the handle the cable 151 is pulled upward. Then, at the opposite end of the actuator 800, the cable 151 rotates the pulley 812 and urges the plate 140 backwards, via the second cable 804 that is attached to the plate 140, thus compressing the spring 802.

FIGS. 9A-C, 10 and 11A-B illustrate another embodiment of the invention in a second tool 200 which optionally cooperates with tool 100 to collect and store animal waste that is pushed off of tines 130 by plate 140.

Tool 200 comprises a container 220 having a front opening 221 and a preferably a rear top opening 222. An elongated upward extending shaft 210 is disposed at the top 225 of the container 220 between the rear top opening 222 and the upper edge 221*a* of the front opening 221. Preferably, as the upper end of shaft 210 is meant to be held by the user, it includes a soft or ergonomic grip portion 211. A plastic bag 10 is preferably inserted into the body of the container 220 so that its open side 11 can be enlarged to extend the top edge 11*a* beyond the perimeter of the front opening 221. The bag 10 is secured in the container 220 by either the top edge 11 a or parts of the immediately adjacent side portion inserted into a plurality of 2 or more apertures 240 distributed on 2 or more sides of the container proximal to the perimeter of the front opening 221. Preferably, the apertures 240 include a rubber gasket on the inner surface, as shown. The friction between the gasket of the apertures 240 and the sides of bag 10 that are folded together to fit in the apertures 240 provides sufficient holding force. It should be appreciated that slot, clips and like other hold down mechanism can be provided in place of the apertures 240 and still obtain the benefits thereof Preferably tool 200 is appropriately sized for use with tool 100 to collect animal waste there within. Specifically the front opening 221 of container 220 of the collection tool 200 is intended to be wider than the plate 140 and tines 130 of the tool 100, and the depth of the container from the front opening 221 to the opposite closed side deep enough to largely accommodate a substantial portion of the length of the tines 130 so that when waste is swept off of the tines 130, it is deposited in the bag 10.

Further, rear opening 222 then facilitates removal of the bag 10 with waste without contaminating the user/operator or the container portion 220, as the outside of the bag 100 is readily grasped through this rear opening 222, and closed with the hand, and pulled out in a state ready for disposal in a proper trash receptacle as shown in FIG. 10B.

In a preferred embodiment the tools 100 and 200 are provided in the form of a collection kit. In a more preferred embodiment, the kit deploys a connector, such as clip 113, to hold the shafts 120 and 220 together for transport and storage.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims. For example, it should be appreciated that alternative embodiments also include combination of mechanisms shown in one embodiment with those shown in another.

I claim:

1. A tool kit for animal waste disposal comprising:

a) a first tool comprising:

i) a shaft having a top and a bottom, ii) a handle at the top of the shaft, iii) a lateral lifting surface disposed in a first common plane, said first common plane being substantially horizontal to and coupled to the bottom of said shaft, iv) a plate disposed perpendicular to and immediately above said lateral lifting surface, v) an actuator coupling said handle to said plate wherein an operation of said actuator via said handle urges said plate to translate laterally within said first common plane perpendicular to and over said lateral lifting surface, b) a second tool comprising:

i) a shaft having a top and a bottom, ii) a handle at the top of the shaft, iii) a container at the bottom of the shaft, the container comprising, (1) a front opening (2) a plurality of 2 or more apertures distributed on 2 or more sides of the container proximal to the perimeter of the front opening, iv) wherein the shaft is connected to the container on a portion of the container behind the front opening, and c) wherein said lateral lifting surface and said plate of said first tool fits substantially with the front opening of said second tool.

2. The tool for animal waste disposal according to claim 1, further comprising a connector that hold the shafts of the first and second tool together.

3. The tool for animal waste removal according to claim 2, wherein the container further comprises a partial top opening wherein the shaft is connected to the container on a portion of the container between the front opening and the partial top opening.

4. The tool kit for animal waste disposal according to claim 1, wherein said lifting surface comprises a plurality of tines and said lower portion of said plate of the first tool has an interdigitated contour around said tines.

5. The tool kit for animal waste disposal according to claim 1, wherein said actuator of the first tool further comprises a spring to bias the plate to a lateral position when the handle does not engage the actuator.

6. The tool kit for animal waste disposal according to claim 5, wherein energy stored in said spring of the first tool urges the plate forward to remove waste from the tines when the actuator is not engaged.

7. The tool kit for animal waste disposal according to claim 5, wherein the tines have a curvilinear shape.

8. The tool kit for animal waste disposal according to claim 7, wherein the second rotary coupling has gear teeth and the gear coupling is a flat gear track coupled to the side of the plate opposite the tines which engages gear teeth in the second rotary coupling.

9. The tool kit for animal waste disposal according to claim 5, wherein the actuator further comprises;

a) a lever coupled to the handle, b) a cable having a first end connected to the lever, and a second end, c) at least one rotary coupling disposed between the first and second ends of said cable for modifying the direction of movement of the cable when pulled by said lever, d) a pair of folding hinged members that connect said plate to the bottom of said shaft wherein the second end of said cable is connected to at least one of the hinged members and wherein the lever causes the rotation of the rotary coupling and the plate is urged backward via the folding hinged member and said spring is also coupled to the folding hinged member to resist the movement of said handle and rotation of the rotary coupling.

10. The tool kit for animal waste disposal according to claim 9, wherein said spring is a torsion spring coupled to the hinged members to bias the horizontal position of said plate.

11. The tool kit for animal waste disposal according to claim 1, wherein the actuator of the first tool rotates said plate in the first common plane.

12. The tool kit for animal waste disposal according to claim 1, wherein the first tool further comprises guide rails above the sides of the lifting surface that is coupled to at least one of said plate and the bottom of the shaft.

13. The tool kit for animal waste disposal according to claim 12, wherein the guide rails of the first tool are coupled to the bottom of the shaft and extend through mating holes in said plate as said plate is moved in response to said actuator.

14. A tool kit for animal waste disposal comprising:

a) a first tool for animal waste removal, the first tool comprising:

i) a shaft having a top and a bottom, ii) a handle at the top of the shaft, iii) a plurality of tines to provide a lateral lifting surface disposed in a first common plane, said first common plane being substantially horizontal to and coupled to the bottom of said shaft, iv) a plate disposed perpendicular and immediately above said plurality of tines, v) an actuator coupling said handle to said plate wherein an operation of said actuator via said handle urges said plate to move in said first common plane perpendicular to said lateral lifting surface; and b) a second tool comprising:

i) a shaft having a top and a bottom, ii) a handle at the top of the shaft, iii) a container at the bottom of the shaft, the container comprising, (1) a front opening (2) a plurality of 2 or more apertures distributed on 2 or more sides of the container proximal to the perimeter of the front opening, iv) wherein the shaft is connected to the container on a portion of the container behind the front opening, and c) wherein said lateral lifting surface and said plate of said first tool fit substantially with the front opening of said second tool.

15. The tool kit for animal waste disposal according to claim 14, wherein said actuator of the first tool further comprises a spring to bias the plate to a lateral position when the handle does not engage the actuator.

16. The tool kit for animal waste disposal according to claim 15, wherein the actuator of the first tool comprises;

a) a lever coupled to the handle, b) a cable having a first end connected to the lever, and a second end, c) at least one rotary coupling disposed between the first and second ends of said cable for modifying the direction of movement of the cable when pulled by said lever, d) a pair of folding hinged members that connect said plate to the bottom of said shaft wherein the second end of said cable is connected to at least one of the hinged members and wherein the lever causes the rotation of the rotary coupling and the plate is urged backward via the folding hinged member and said spring is also coupled to the folding hinged member to resist the movement of said handle and rotation of the rotary coupling.

17. A tool comprising:

a) a shaft having a top and a bottom, b) a handle at the top of the shaft, c) a lateral lifting surface comprising a plurality of spaced apart tines disposed horizontally and coupled to the bottom of the shaft and being disposed generally orthogonal thereto, d) a plate disposed perpendicular to and immediately above said lateral lifting surface, e) an actuator operative upon release to urge said plate to translate over at least a portion of said lateral lifting surface to remove matter from a top surface thereof.

18. The tool for animal waste removal according to claim 17, wherein the actuator is coupled to said plate via a biasing means and is operative on release by a user to urge said plate to translate over substantially an entirety of said lateral lifting surface from a position proximal to the bottom of the shaft to beyond a front edge of the lateral lifting surface.

19. The tool for animal waste removal according to claim 17, further comprises guide rails above sides of the lifting surface that is coupled to at least one of said plate and the bottom of the shaft.

20. The tool for animal waste removal according to claim 17, wherein said actuator comprises;

a) a lever coupled to the handle, b) a cable having a first end connected to the lever, and a second end, c) at least one rotary coupling disposed between the first and second ends of said cable for modifying the direction of movement of the cable when pulled by said lever, d) a pair of folding hinged members that connect said plate to the bottom of said shaft wherein the second end of said cable is connected to at least one of the hinged members and wherein the lever causes the rotation of the rotary coupling and the plate is urged backward via the folding hinged member and a spring is also coupled to the folding hinged member to resist the movement of said handle and rotation of the rotary coupling.

21. A tool comprising:

a) a shaft having a top and a bottom, b) a handle at the top of the shaft, c) a lateral lifting surface disposed horizontally and coupled to the bottom of the shaft and being disposed generally orthogonal thereto, d) a plate disposed perpendicular to and immediately above said lateral lifting surface, e) an actuator operative on release by a user to urge said plate to translate over substantially an entirety of said lateral lifting surface from a position proximal to the bottom of the shaft to beyond a front edge of the lateral lifting surface.

22. The tool for animal waste removal according to claim 21, wherein the the lateral lifting surface comprises a plurality of tines.

* * * * *